US005330230A

United States Patent [19]

Craig

[11] Patent Number: 5,330,230

[45] Date of Patent: Jul. 19, 1994

[54] KIT FOR IDENTIFYING INDIVIDUALY SIZED IMPLEMENTS

[75] Inventor: Donald G. Craig, Tilghman, Md.

[73] Assignee: Peter A. Norton, Waukesha, Wis.

[21] Appl. No.: 986,351

[22] Filed: Jan. 19, 1993

[51] Int. Cl.[5] ..... B42D 15/00

[52] U.S. Cl. ..... 283/81; 283/55; 283/79; 81/DIG. 5

[58] Field of Search ..... 281/2; 283/81, 55, 79, 283/80, 74; 81/DIG. 5

[56] References Cited

U.S. PATENT DOCUMENTS

| | | | |
|---|---|---|---|
| 1,984,839 | 12/1934 | Murray | 81/DIG. 5 X |
| 3,641,319 | 2/1972 | McGuire | 281/2 X |
| 4,344,644 | 8/1982 | Somogyi | 283/55 X |
| 4,846,503 | 7/1989 | Strauss | 283/81 |
| 4,856,820 | 8/1989 | Kasprzak et al. | 283/81 |
| 4,947,713 | 8/1990 | Arnold | 81/121.1 |
| 4,982,627 | 1/1991 | Johnson | 81/DIG. 5 X |
| 5,031,488 | 7/1991 | Zumeta | 81/DIG. 5 X |
| 5,197,764 | 3/1993 | Hicinbothem et al. | 283/81 |

*Primary Examiner*—Mark Rosenbaum
*Assistant Examiner*—Willmon Fridie, Jr.
*Attorney, Agent, or Firm*—Godfrey & Kahn

[57] ABSTRACT

A kit for identifying individually sized objects or implements, such as socket sets and wrenches of all types thereby facilitating visual identification of the individual objects, the kit including a substrate which supports a legend and a predetermined number of bands or strips, each having a particular color. The colored bands or strips are adhesively affixed on particular objects. The color of each band correlates with an object size which is expressed on the legend.

3 Claims, 2 Drawing Sheets

KIT FOR IDENTIFYING INDIVIDUALY SIZED IMPLEMENTS

BACKGROUND OF THE INVENTION

1. Field of the Invention

The present invention relates generally to a kit, and more particularly to a kit which is especially well-suited for identifying individually sized implements, or objects of interest, such as the individual elements of a set of sockets, allen wrenches, box wrenches, open-end wrenches, or the like, and wherein, the kit quickly facilitates the visual identification and selection of an appropriately sized implement.

2. Description of the Prior Art

Socket sets usually include a rachet wrench and a predetermined number of sockets which are used interchangeably with the rachet wrench. The individual sockets, may have, for example, a hexagonal bore for engagement with a suitable fastener such as a nut or a head of a bolt. The hexagonal bores of each of the sockets typically are manufactured in predetermined increments, such as in 1/16 of an inch, or 1 mm increments, as in the case of metrically dimensioned tools. Additionally, box wrenches, open-ended wrenches and allen wrenches are similarly sized for use with suitable fasteners.

Normally, the average set of sockets are identified as to size by being stamped with an appropriate symbol during the manufacturing process. These markings are often difficult to identify, especially when the tool is being selected for use in various environments such as, for example, beneath a vehicle or in cramped quarters or in poorly lighted working spaces. Additionally, the problem in identifying an appropriately sized tool is compounded when the worker may have to utilize both metric and non-metric tools on the same project.

It is known that a colored, or non-colored, preformed elastomeric sleeve, having size indicia molded thereon, may be disposed in interfitted relation on an individual socket to facilitate its visual recognition. However, and while such elastomeric sleeves may be useful for these purposes, these same sleeves are replete with a multiplicity of deficiencies and shortcomings which have detracted from their usefulness.

Foremost among the deficiencies of these preformed elastomeric sleeves is their apparent inability to be utilized in combination with other irregularly shaped tools or implements, such as, for example, box wrenches or open-end wrenches. More particularly, the elastomeric sleeves of the prior art are specifically designed to engage a substantially, cylindrically shaped exterior surface, such as the rearward portion of the socket.

Additionally, another significant deficiency of the preformed sleeves of the prior art is their apparent inability to be utilized with sockets which are produced by various manufacturers. More particularly, and if a user has sockets which do not have the same outside diameter, then, in that event, the preformed sleeves will not be operable for their intended purposes.

The foregoing illustrates the several limitations known to exist in the prior art. Therefore, it has long been known that it would be advantageous to provide a means for overcoming one or more of the limitations set forth above. Accordingly, a suitable kit is provided which overcomes the noted deficiencies and which further includes additional features which are more fully disclosed hereinafter.

SUMMARY OF THE INVENTION

The present invention is directed to a kit for identifying individually sized implements, and wherein the kit is especially well-suited for identifying implements which may have a regular or an irregularly shaped surface thereby facilitating the visual identification of the implement.

Another object of the present invention is to provide a kit which includes a substrate having a display surface which supports a legend, and wherein the legend includes a predetermined number of colored indicia which are directly associated or correlated with a range of implement sizes.

Another object of the present invention is to provide a kit whereby an individual may quickly compare the labeling indicia applied to an implement and compare it with the legend thereby providing a means for conveniently recognizing the correct implement.

Another object of the present invention is to provide a kit for identifying individually sized implements, and wherein the kit may be manufactured easily, and economically.

These and other objects and advantages of the present invention are achieved by a kit for identifying individually sized implements, and wherein the kit includes a substrate having a display surface and which supports a legend; and individual labeling indicia for identifying the individual implements are releasably affixed on the substrate and removable therefrom, and wherein the individual labeling indicia are each applied directly on the implement which corresponds in size to the legend, and wherein during use of the implement, the labeling indicia is compared with the legend for the convenient visual identification of the implement by a user.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

First Form

Figure 1:
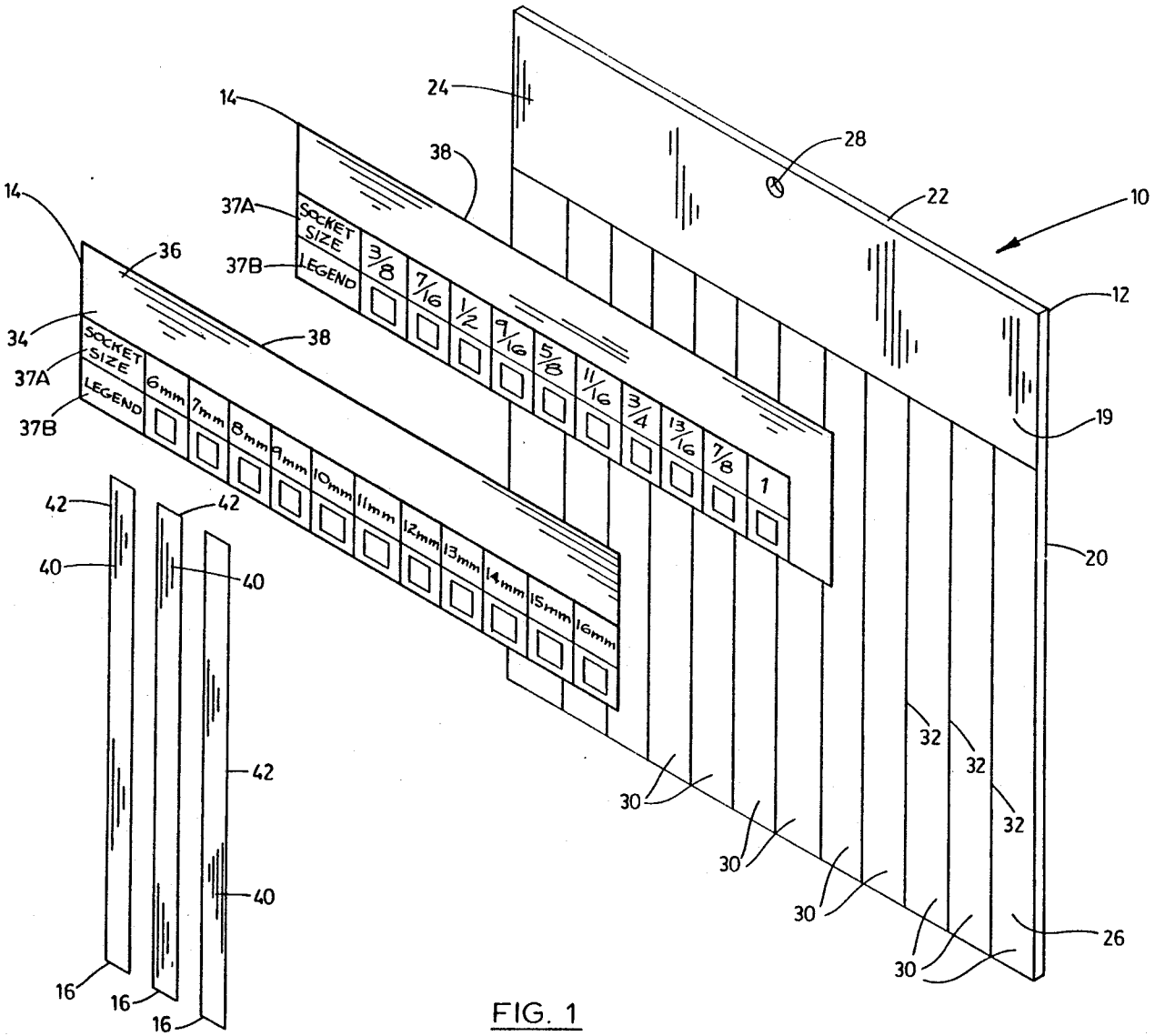
FIG. 1 illustrates a perspective, exploded view of a kit in accordance with the teachings of the present invention.

The first form of the present invention is best illustrated by reference to FIG. 1. As shown therein, the kit for identifying individually sized implements is designated generally by the numeral 10. The kit includes a substrate 12, a legend 14, and a predetermined number of flexible bands or strips 16 for identifying individual implements, such as a socket 17 or a wrench 17A. These tools are best illustrated by references to FIGS. 3 and 4, respectively. As should be understood, the bands or strips 16 are operable to be adhesively affixed on an exterior facing surface of an implement, such as an exterior surface 18 of the socket 17, or the exterior surface 18A of the wrench 17A, thereby identifying the implement and further facilitating its visual identification at a later time. As will be recognized, the flexible bands will conform to any surface shape. Further, and while the drawings illustrate a simple pattern of band application, that is, the band wrapped upon itself, it will be recognized that a short strip could be applied directly to the tool if one did not desire to wrap the band entirely around the tool. Additionally, it will be recognized that in the case of the wrench 17A, one could wrap a band in a substantially helical pattern about the shaft of the tool if that was desired.

The bands or strips 16 may also be individually segmented and thereafter applied to a supporting substrate, or fastener to identify the size of the fastener received therethrough (not shown). For example, it is often difficult to correctly identify the correct size of an allen screw. In this situation, a segment of colored tape could be attached to a substrate in the vicinity of the allen screw to facilitate the selection of the correct allen wrench. This may also apply to other fasteners such as nuts, and the like.

The substrate 12, which generally operates as a display, is generally planar and may be manufactured from any suitable material such as all manner of cellulosic based substrates, synthetic substrates, and other polymeric based materials and even metal. Further, the substrate may be either flexible, or rigid. The substrate 12 includes a first, forward, or display surface 19 and an opposite, second, or rearwardly disposed surface 20. The substrate 12 has a predetermined shape which is defined by a peripheral edge 22. The substrate 12 is shown in the drawings as being rectangularly shaped, however, it will be recognized that the substrate 12 may take on any desired shape, such as a circle, for example. The first surface 19 of the substrate 12 includes an upper portion 24, and a lower portion 26. The upper portion 24 supports or receives the legend 14 for viewing by a user. An aperture 28 is formed in the substrate and is suitably located on the upper portion 24. The aperture 28 is dimensioned to receive a nail, hook, screw or other suitable fastener (not shown) to permit a user to position the substrate 12 on another supporting surface, such as on a wall or a work bench (not shown). However, it is anticipated that the aperture 28 may be replaced by any suitable equivalent, such as a bracket or a hanger (also not shown). The lower portion 26 is subdivided into discrete areas 30 by individual lines which are generally indicated by the numeral 32. Additionally, the first surface 19 and more particularly, the lower portion 26 thereof, has deposited thereon a suitable release coating, such as a silicone based release coating, for example. As will be described in further detail hereinafter, each of the discrete areas 30 releasably supports or receives an individual band or strip 16.

The first form of the invention may also include a second legend (not shown) and which has applied thereto a pressure sensitive adhesive. In this particular instance, a silicone release sheet would be applied over the adhesive. The second legend would be supplied with first form of the invention to provide a convenient means by which the legend may be affixed to a tool box or kit (not shown) and thus be carried to a work site where the tools are utilized. Of course, in many instances, the tools may be employed in diverse locations so it is possible that several pressure sensitive legends may be supplied to facilitate the use of the tools at various remote locations.

In the first embodiment of the present invention, and as best illustrated in FIG. 1, the legend 14 includes a main body 34 having a first, display surface 36 which has both the size and colored indicia printed thereon, 37A and 37B, respectively; and an opposite, second, supporting surface 38. The main body 34 is suitably dimensioned to be matingly supported or positioned in covering relation relative to the upper portion 24 of the substrate 12. As will be appreciated by a study of FIG. 1, the size indicia 37A, of the legend 14, defines a predetermined range of implement sizes which are each matched or substantially correlated with the individual colored indicia 37B, which are located immediately below. As will be recognized, two discreet legends are shown in FIG. 1 and which illustrate how the present kit could be employed for identifying implements such as tools which are manufactured in metric and non-metric units. For example, solid colors may be applied to all non-metric tools. Additionally, and to provide a means for being able to visually discern between the metric and non-metric tools, the bands may be manufactured in such a fashion whereby two colors are present on each of the bands, such as, for example, blue and white. These bands would be applied, for example, to tools which are manufactured in metric units.

The opposite, second surface 38 of the legend 14 includes a layer of pressure sensitive adhesive material which is deposited thereon and which affixes the legend on the substrate 11. It should be understood that by removably attaching the legend 14 on the display surface 19, the user may utilize the legend 14 which is expressed in non-metric units, when a work project requires employing tools of that type, and when the work project requires metric tools, the legend expressed in non-metric units is replaced with a legend expressed in metric units.

Figure 3:
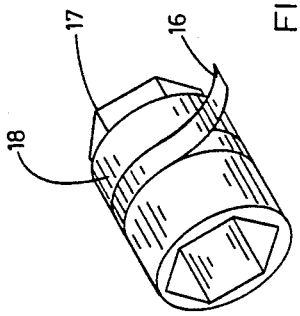
FIG. 3 illustrates a perspective view of a socket which is identified in accordance with the teachings of the present invention.
Figure 4:
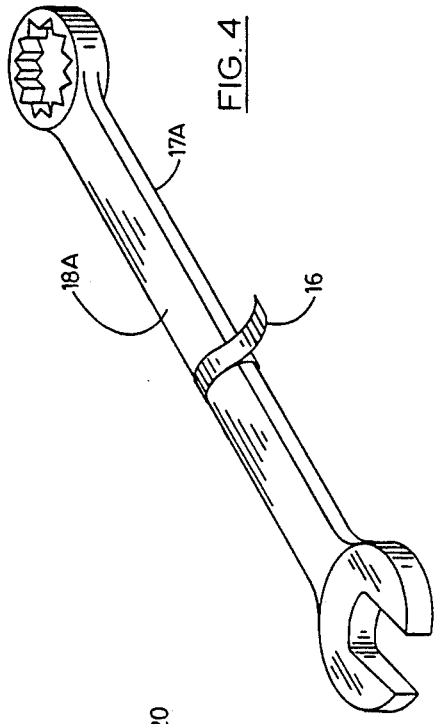
FIG. 4 is a perspective view of a wrench which is identified in accordance with the teachings of the present invention.

As best illustrated in FIGS. 3 and 4, the bands or strips 16 have a length dimension such that they may be individually wrapped about, or otherwise affixed upon the exterior facing surface of a tool or other implement, as described above. The bands or strips are manufactured from suitable polymeric based substances. Additionally, and while the drawings illustrate that each of the bands have a uniform length, it will be appreciated that the individual bands may have a variable length. In particular, it will be recognized, that the outside diametral dimension of smaller sockets require a band having a shorter length as compared with sockets having a greater outside diametral dimension. Therefore, the invention is not limited to kits employing bands having a uniform length dimension as disclosed herein.

Each individual band or strip 16 has a distinct predetermined color or colors which correspond to discreet colored indicia which are printed on the legend 14. Further, each band or strip 16 includes a first, colored, display surface 40 and an opposite or second surface 42 which has a layer of pressure sensitive adhesive deposited thereon. As should be understood, the bands, and the pressure sensitive adhesive substance should preferably be of a type which resists degradation when exposed to hydrocarbon based substances such as, for example, oil, gasoline, transmission fluid, or the like.

Second Form

Figure 2:
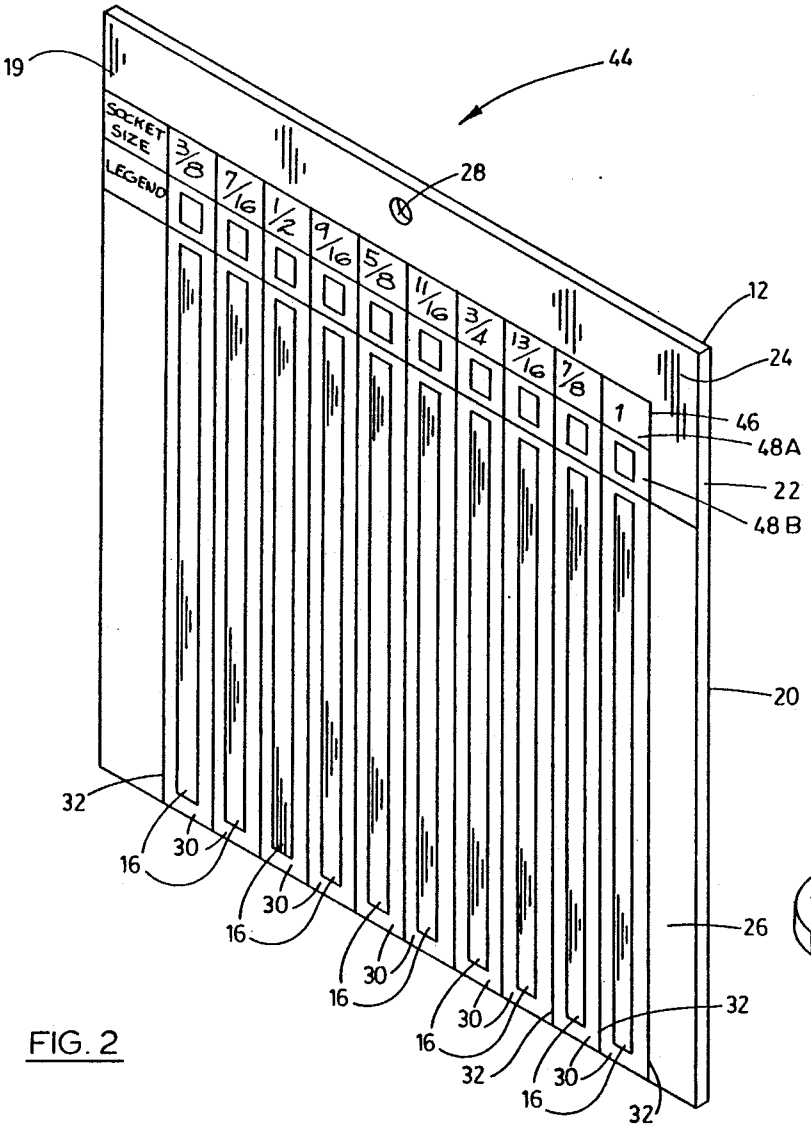
FIG. 2 illustrates a perspective view of an alternate embodiment of the present invention.

FIG. 2 illustrates at 44, a second form of the kit for identifying individually sized implements. The kit 44 includes the substrate 12; a legend 46; and the bands or strips 16. The substrate 12, and the individual bands 16 have been described in detail, above, and are not described in any further detail herein. In the second form of the invention, however, the legend 46, of the kit 44, is printed directly onto the upper portion 24 of the display surface 19 of the substrate 12. The legend includes size, information, and colored indicia 48A and 48B, respectively. As will be appreciated, the substrate 12 may be printed with a legend 46 which is expressed in metric or non-metric units.

OPERATION

The operation of the present forms of the subject invention are believed to be readily apparent and are briefly summarized at this point.

The two forms of the subject invention and which are illustrated at numeral 10 in FIG. 1, and 44 in FIG. 2, respectively, are operable to facilitate the visual identification of an implement, such as a socket 17 or a wrench 17A. In operation, a user removes a predetermined colored band or strip 16 from the substrate 12. The colored band 16 is then compared with the colored indicia and the correlating size which is expressed on the legend. The band 16 is thereafter adhesively affixed or positioned on a correspondingly sized implement or tool. This identifying procedure is repeated until all implements which a user desires to label, have been identified in accordance with the teachings disclosed herein.

Thereafter, and during use of the present invention, a user references the legend to facilitate the visual identification of a desired implement or tool. For example, if a user requires a ⅜" wrench, the user will reference the legend to determine what colored indicia correlates with the a ⅜" wrench. For example, if the ⅜" wrench is labeled with a band which has a red color, the user then searches his work area for an implement labeled with a red band.

Therefore, it will be seen that the kit of the present invention provides a convenient, and inexpensive means by which a user may visually identify a desired implement without resorting to reading the size indicia which is printed thereon, the invention being easy to utilize, simple to employ and which further can be employed with all manner of tools or other implements which may have both regular, and irregularly shaped surfaces.

It is understood that the invention is not confined to the particular construction and arrangement of parts herein illustrated and described, but embraces such modified forms thereof as will come within the scope of the following claims.

Having described my new invention, what I claim as new and desire to secure by letters patent of the United States is:

1. A kit for identifying individually sized objects, the kit having component parts capable of being utilized at a remote location to facilitate the visual identification of an object, the kit comprising:

a substrate having a display surface which supports a legend having a predetermined number of colored indicia which are directly correlated with a predetermined range of object sizes, and wherein the legend further includes a first display surface, and an opposite second surface, and wherein the second surface has an adhesive layer deposited thereon, and wherein the adhesive layer adhesively affixes the legend on the display surface of the substrate; and individual labelling indicia for identifying the individual objects, and wherein the individual labeling indicia are releasably affixed on the display surface of the substrate, the labeling indicia applied selectively to objects having a corresponding size, and wherein the labeling indicia is compared to the legend for visual identification of an object by a user.

2. A kit, as claimed in claim 1, and wherein the labeling indicia includes a predetermined number of discreet bands, each band having a predetermined color which correlates with individual colored indicia of the legend.

3. A kit, as claimed in claim 2, and wherein each band includes a first display surface, and an opposite second surface, and wherein the second surface has a layer of pressure sensitive adhesive deposited thereon, and wherein the discreet bands may have uniform or variable length dimensions.

* * * * *